US011524871B2

(12) United States Patent
Shi

(10) Patent No.: US 11,524,871 B2
(45) Date of Patent: Dec. 13, 2022

(54) ACTUATOR, REMOTE TRIGGERING DEVICE, GOVERNOR ASSEMBLY AND ELEVATOR

(71) Applicant: Otis Elevator Company, Farmington, CT (US)

(72) Inventor: Zhengbao Shi, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1086 days.

(21) Appl. No.: 16/169,595

(22) Filed: Oct. 24, 2018

(65) Prior Publication Data

US 2019/0127179 A1 May 2, 2019

(30) Foreign Application Priority Data

Oct. 27, 2017 (CN) ..... 201711021610.X

(51) Int. Cl.
*B66B 5/04* (2006.01)
*H01F 7/124* (2006.01)
(Continued)

(52) U.S. Cl.
CPC ..... *B66B 5/044* (2013.01); *B66B 5/048* (2013.01); *H01F 7/121* (2013.01); *H01F 7/123* (2013.01); *H01F 7/124* (2013.01); *H01F 7/1607* (2013.01)

(58) Field of Classification Search
CPC ..... B66B 5/044; B66B 5/046; B66B 5/048; H01F 7/121; H01F 7/123; H01F 7/124
See application file for complete search history.

(56) References Cited

U.S. PATENT DOCUMENTS 4,614,097 A * 9/1986 Signorelli ..... E05B 67/365 70/386
4,623,860 A * 11/1986 Baker ..... H01F 7/124 200/321

(Continued)

FOREIGN PATENT DOCUMENTS

CN 206266033 U 6/2017
DE 8601378 U1 7/1987

(Continued)

OTHER PUBLICATIONS

European Search Report for application 18205706.7, dated Apr. 9, 2019, 7 pages.

*Primary Examiner* — Minh Truong
(74) *Attorney, Agent, or Firm* — Cantor Colburn LLP

(57) ABSTRACT

An actuator, a remote triggering apparatus, a governor, and an elevator. The actuator includes: a mandrel, the mandrel having a proximal end and a distal end, and the mandrel being driven to move from a contraction position toward an actuation position; a mandrel sleeve; and a shell, the shell defining a channel, wherein the actuator further includes at least one sliding member, and when the mandrel moves from the contraction position toward the actuation position, the at least one sliding member is located at a first radial position where the mandrel is joined to the mandrel sleeve, such that the mandrel sleeve can move along the channel together with the mandrel; and wherein at the actuation position, the at least one sliding member moves outward radially to a second radial position where the mandrel sleeve is joined to the shell, thus locking the mandrel sleeve.

22 Claims, 6 Drawing Sheets

(51) Int. Cl.

| | |
|---|---|
| ***H01F 7/16*** | (2006.01) |
| ***H01F 7/121*** | (2006.01) |
| ***H01F 7/123*** | (2006.01) |

(56) References Cited

U.S. PATENT DOCUMENTS

| | | | | |
|---|---|---|---|---|
| 4,771,255 | A * | 9/1988 | Shull | H01F 7/124 335/169 |
| 4,923,055 | A | 5/1990 | Holland | |
| 4,951,552 | A * | 8/1990 | Fox | F15B 15/261 92/24 |
| 5,183,978 | A | 2/1993 | Sheridan et al. | |
| 5,321,216 | A | 6/1994 | Jamieson et al. | |
| 5,381,295 | A * | 1/1995 | Rund | H02J 7/0031 361/72 |
| 5,492,200 | A | 2/1996 | Korhonen | |
| 7,766,128 | B2 | 8/2010 | Takeuchi et al. | |
| 8,827,044 | B2 | 9/2014 | Marvin et al. | |
| 2008/0149431 | A1* | 6/2008 | Vantanen | B66B 5/04 187/287 |
| 2013/0098711 | A1 | 4/2013 | Aguado et al. | |
| 2017/0190545 | A1 | 7/2017 | Dube et al. | |
| 2020/0291678 | A1* | 9/2020 | Eickhoff | E05B 47/0012 |

FOREIGN PATENT DOCUMENTS

| | | | | |
|---|---|---|---|---|
| DE | 102005056435 | A1 | 6/2007 | |
| EP | 1808397 | A1 | 7/2007 | |
| EP | 2380840 | A1 | 10/2011 | |
| EP | 3021343 | A1 | 5/2016 | |
| GB | 2484110 | A * | 4/2012 | E05B 17/2011 |
| KR | 100709506 | B1 | 4/2007 | |
| WO | 2009130366 | A1 | 10/2009 | |
| WO | 2011048270 | A1 | 4/2011 | |
| WO | WO-2021096768 | A1 * | 5/2021 | H01F 7/088 |

* cited by examiner

ACTUATOR, REMOTE TRIGGERING DEVICE, GOVERNOR ASSEMBLY AND ELEVATOR

FOREIGN PRIORITY

This application claims priority to Chinese Patent Application No. 201711021610.X, filed Oct. 27, 2017, and all the benefits accruing therefrom under 35 U.S.C. § 119, the contents of which in its entirety are herein incorporated by reference.

TECHNICAL FIELD

The present invention relates to the related field of actuators, and in particular, the present invention relates to a self-locking actuator and an application of the actuator in the field of elevators.

BACKGROUND ART

With the development of technologies for governor assemblies of elevators, new Car Mounted Governor (CMG) assemblies are more widely applied. Compared with a conventional governor assembly with or without a machine room, the car mounted governor assembly has a more compact structure. The US Patent Publication No. US2013/0098711A1 published by Aguado et al. on Apr. 25, 2013 has disclosed a governor assembly. In such a governor assembly, when a rotating speed of a sheave exceeds a certain value, a centrifugal mechanism that rotates together with the sheave is triggered such that the sheave drives a core ring related to a safety apparatus to rotate, thereby triggering the governor assembly, including triggering a safety switch to stop supplying power and enabling the safety apparatus to generate mechanical friction with a channel to brake a car. The patent is incorporated here by reference in its entirety. In such a car mounted governor assembly, the governor assembly further includes a remote triggering apparatus. The remote triggering apparatus can be controlled actively to act on the centrifugal mechanism, such that the governor assembly can be triggered actively even that the car is not stalled, so as to achieve an objective such as testing. The existing remote triggering apparatus is mainly composed of an electromagnet, and a tail end of a column of the electromagnet directly acts on the centrifugal mechanism that is generally made of plastic.

In the past applications, the CMG is generally applied to low-speed elevators. The Chinese Utility Model Patent No. ZL201621141734.2 submitted by the Otis Elevator Company on Oct. 20, 2016 and entitled "REMOTE TRIGGERING APPARATUS, GOVERNOR ASSEMBLY, AND ELEVATOR" has disclosed a remote triggering apparatus. A contact having a smooth transition surface is adopted in the remote triggering apparatus, for attempting to apply the CMG to a high-speed elevator. The patent is incorporated here by reference in its entirety.

SUMMARY OF THE INVENTION

The present invention is aimed at solving or at least alleviating the problems in the prior art; in one aspect, the present invention is aimed at providing an actuator that is self-locked at an actuation position, to prevent the actuator from retracting after being impacted; in another aspect, the present invention is aimed at preventing a mandrel of the actuator from being impacted; in another aspect, the present invention is aimed at lowering the requirements for electromagnetic forces of the actuator, thereby lowering the requirements for the actuator; and in another aspect, the present invention is aimed at improving the reliability of a remote triggering apparatus, a governor, and an elevator.

An actuator is provided, including: a mandrel, the mandrel having a proximal end and a distal end, the mandrel being driven to move from a contraction position toward an actuation position; a mandrel sleeve, the mandrel sleeve being sleeved on the distal end of the mandrel; and a shell, the shell defining a channel, wherein the actuator further includes at least one sliding member, and when the mandrel moves from the contraction position toward the actuation position, the at least one sliding member is located at a first radial position where the mandrel is joined to the mandrel sleeve, such that the mandrel sleeve can move along the channel together with the mandrel; and wherein at the actuation position, the at least one sliding member moves outward radially to a second radial position where the mandrel sleeve is joined to the shell, thus locking the mandrel sleeve.

A related remote triggering apparatus, a governor, and an elevator are further provided.

BRIEF DESCRIPTION OF THE DRAWINGS

Content disclosed in the present invention will be more easily understood with reference to the accompanying drawings. It should be easily understood by those skilled in the art that these accompanying drawings are merely used for illustration rather than limiting the protection scope of the present invention. Moreover, similar numerals in the drawings are used to represent similar components, wherein.

DETAILED DESCRIPTION

It is easily understood that those of ordinary skill in the art can propose various interchangeable structural modes and implementation manners without changing the essential spirit of the present invention. Therefore, the following specific implementation manners and accompanying drawings are exemplary illustrations of the technical solutions of the present invention and should not be considered as all of the present invention or considered as definitions or limitations to the technical solutions of the present invention.

Orientation terms such as upper, lower, left, right, front, rear, front, back, top, and bottom that are or might be mentioned in the specification are used for definition with respect to constructions shown in the accompanying drawings, and they are relative concepts and are possibly changed correspondingly according to their different positions and different use states. Therefore, these or other orientation terms should not be construed as limitative terms.

Figure 1:
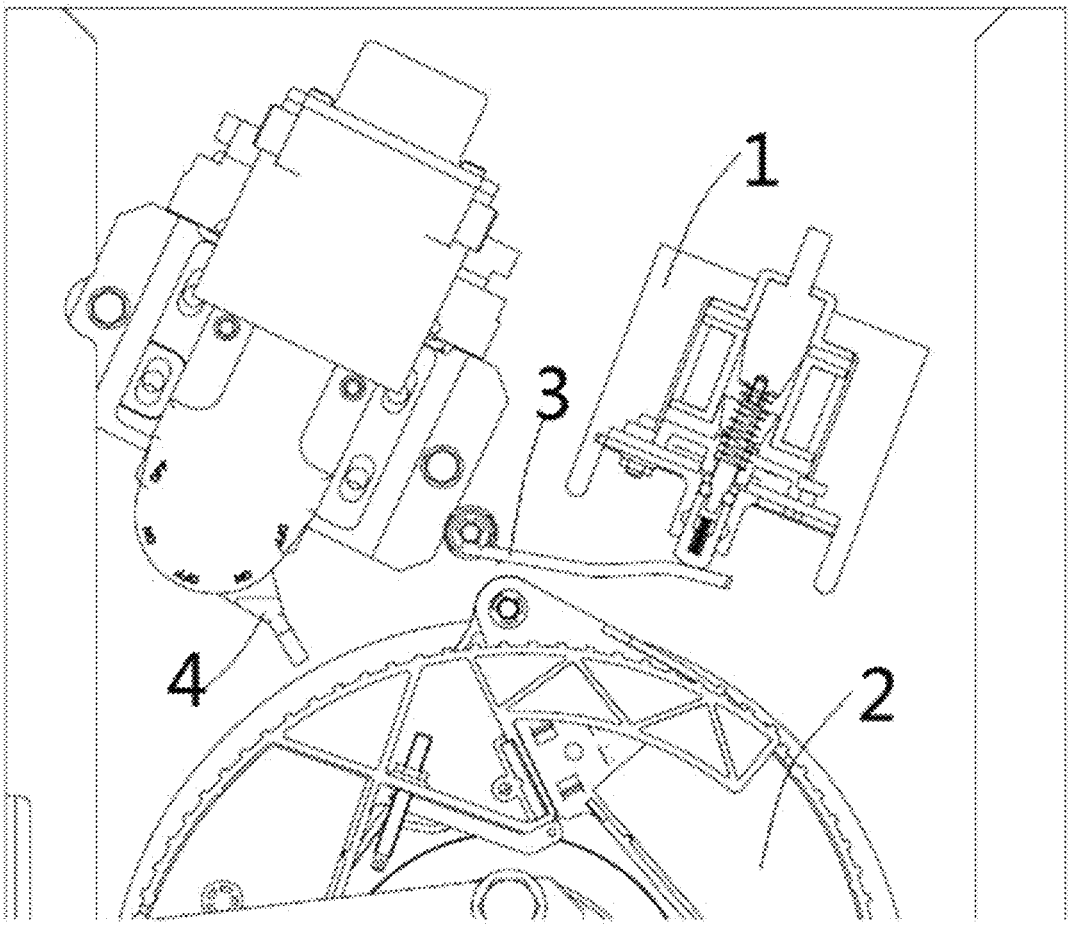
FIG. 1 shows a schematic diagram of a governor according to an embodiment.
Figure 2:
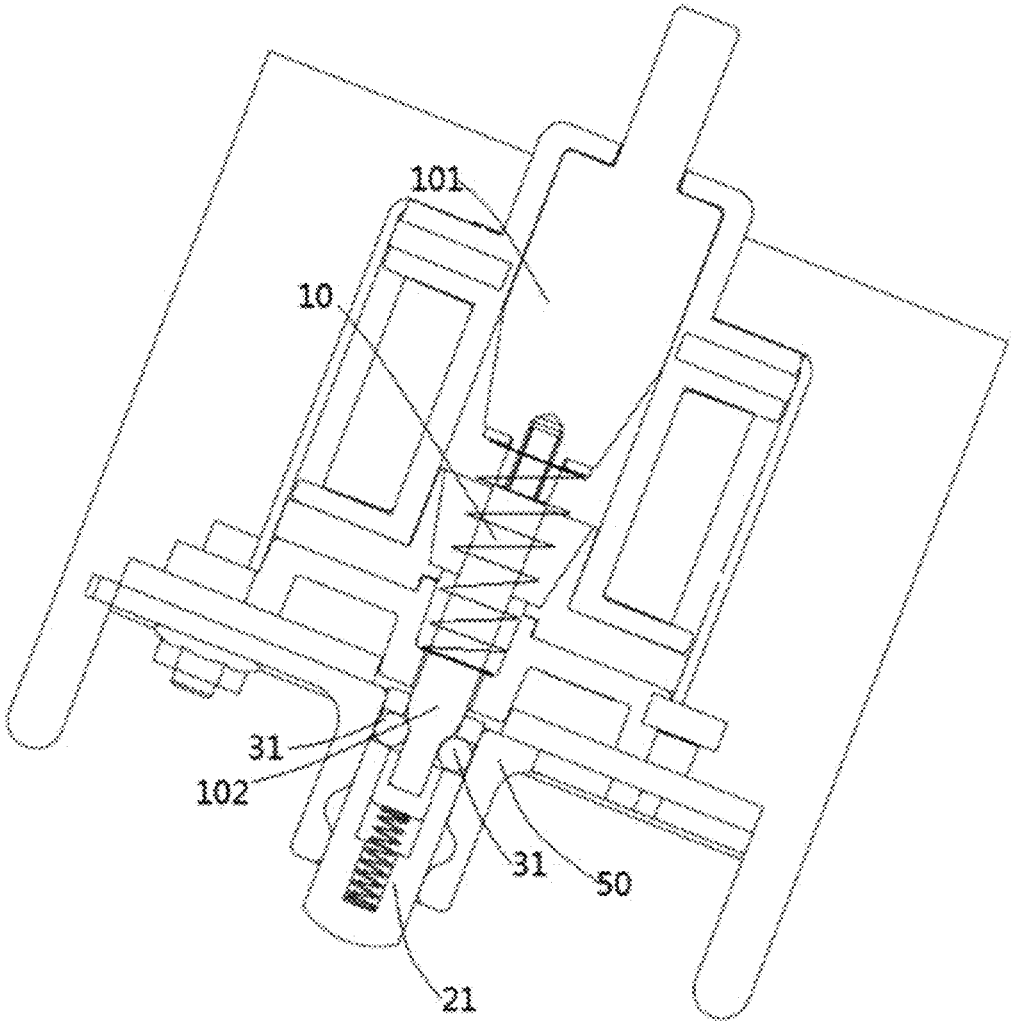
FIG. 2 shows a schematic diagram of an actuator located at a contraction position according to an embodiment.
Figure 5:
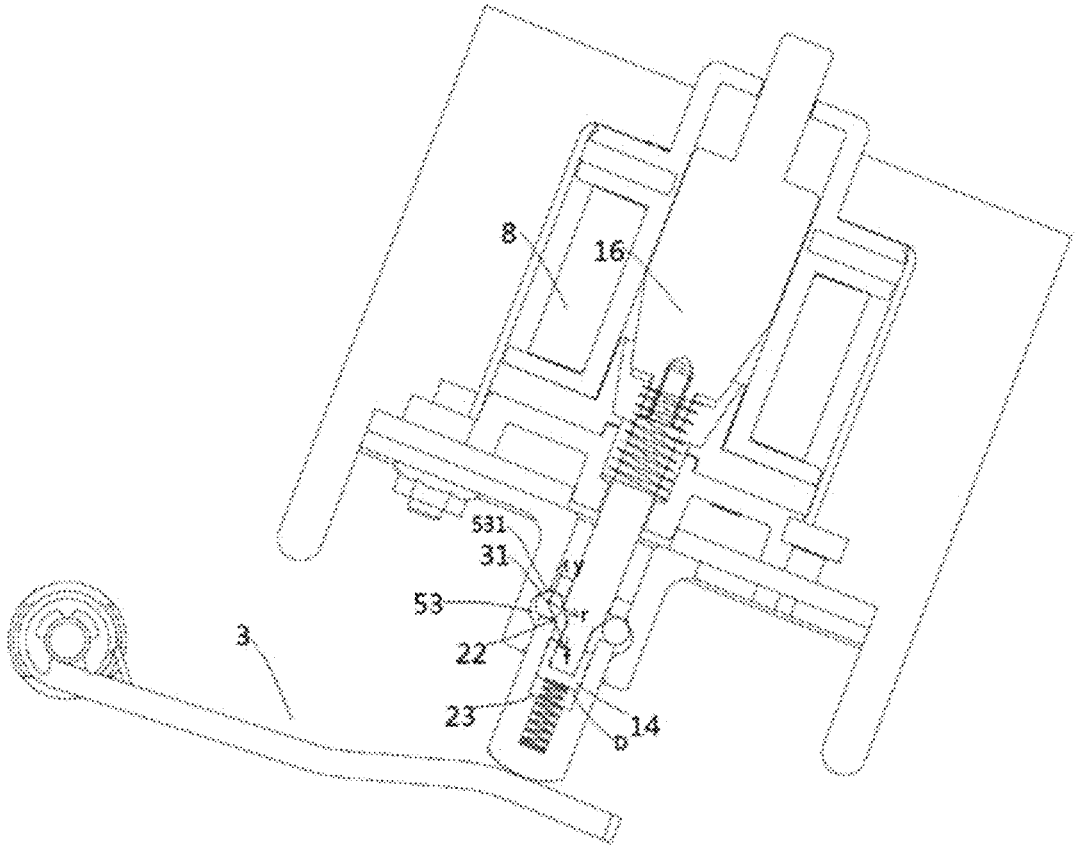
FIG. 5 shows a schematic diagram of a remote triggering apparatus that just arrives at an actuation position according to an embodiment.

The apparatus of the present invention is explained now with reference to the accompanying drawings. First, referring to FIG. 1, a governor assembly of an elevator system is shown. The governor assembly includes a sheave 2 having a centrifugal mechanism, a governor switch 4, and a remote triggering apparatus. The remote triggering apparatus includes an actuator 1 and a contact mechanism 3. FIG. 2 shows an enlarged diagram of the actuator 1, including: a mandrel 10, the mandrel 10 having a proximal end 101 and a distal end 102, the proximal end 101 of the mandrel 10 being driven such that the mandrel 10 moves from a contraction position as shown in FIG. 2 to an actuation position as shown in FIG. 5. When the mandrel is located at the contraction position, the remote triggering apparatus does not trigger the governor, and when the mandrel is located at the actuation position, the remote triggering apparatus will interfere with the governor and trigger the governor. The actuator 1 further includes a mandrel sleeve 21, the mandrel sleeve 21 being sleeved on the distal end 102 of the mandrel 10; and a shell 50, the shell 50 defining a channel in which the mandrel sleeve 21 moves. The actuator further includes at least one sliding member 31, and in a process that the mandrel 10 moves from the contraction position toward the actuation position, at least one sliding member 31 is located at a first radial position where the mandrel 10 is joined to the mandrel sleeve 21, such that the mandrel sleeve 21 can move along the channel together with the mandrel 10. Moreover, at the actuation position, at least one sliding member 31 moves outward radially to a second radial position where the mandrel sleeve 21 is joined to the shell 50, thus locking the mandrel sleeve. In the foregoing description, the first radial position and the second radial position use a center line of the mandrel 10 as a reference. In the foregoing description, the term "at least one sliding member 31" includes one sliding member and multiple sliding blocks. When the "at least one sliding member 31" represents multiple sliding blocks, the terms "first radial position" and "second radial position" are intended to represent a respective first radial position and a respective second radial position corresponding to each sliding block.

Figure 3:
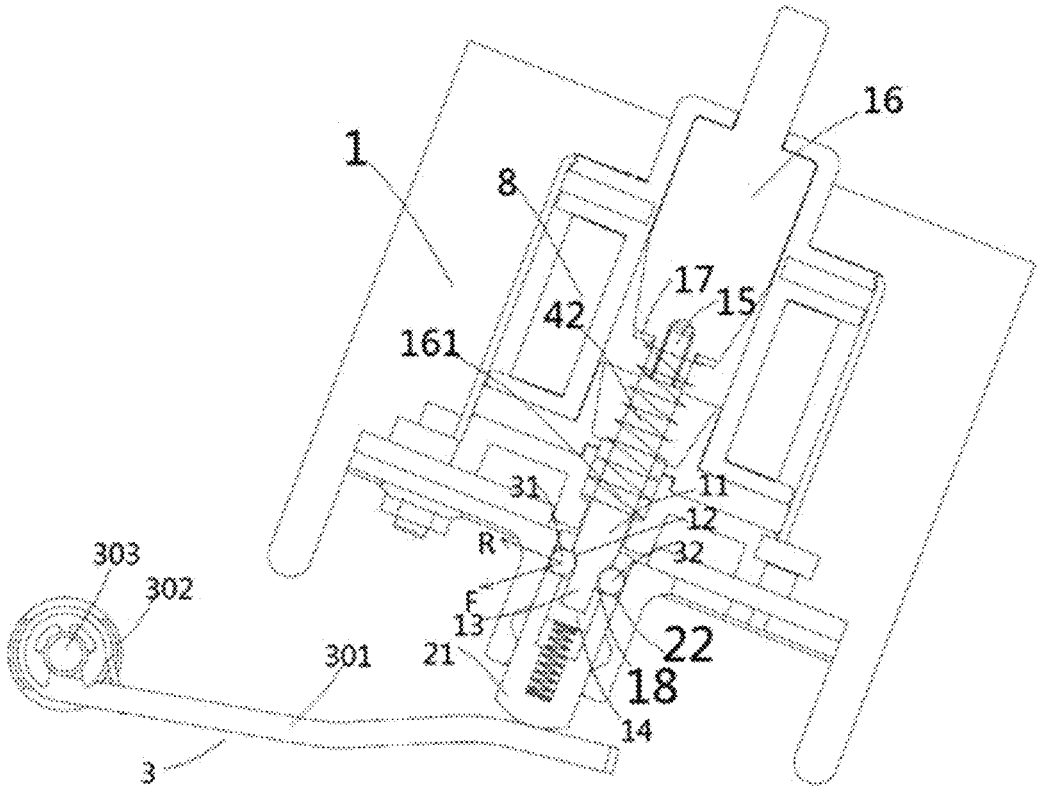
FIG. 3 shows a schematic diagram of a remote triggering apparatus located at a contraction position according to an embodiment.

As shown in FIG. 3, in some embodiments, the mandrel 10 can include a mandrel stick 16 at the proximal end and a mandrel rod 161 at the distal end. In the embodiment in the drawing, the mandrel stick 16 has a threaded hole, a proximal end of the mandrel rod 161 has a bolt 15, and the mandrel rod 161 is threaded to the mandrel stick 16. In an alternative embodiment, the mandrel rod 161 can also be connected to the mandrel stick 16 in another manner. In this embodiment, the mandrel stick 16 can be made of a magnetic material. A coil 8 is arranged at the periphery of the mandrel stick 16, and the mandrel stick 16 is driven by a magnetic field generated after the coil 8 is powered on, so as to drive the mandrel rod 161 to move toward the actuation position together. The mandrel stick 16 and the mandrel rod 161 are separated, such that the mandrel rod 161 is allowed to be made of a material different from that of the mandrel stick 16, thus being conducive to complex shaping and machining of the mandrel stick 16 and the mandrel rod 161. Definitely, in an alternative embodiment, the mandrel stick 16 and the mandrel rod 161 can also be formed integrally.

As shown in FIG. 3, in some embodiments, the mandrel includes at least one slope 12. The slope 12 acts on at least one sliding member 31 and applies a radially outward component force to the at least one sliding member 31, and the radially outward component force urges the at least one sliding member 31 to move from the first radial position to the second radial position. In some embodiments, the mandrel 10, e.g., the mandrel rod 161 thereof, can include a mandrel body 11, a mandrel contraction part 13, and a slope 12 located between the mandrel body 11 and the mandrel contraction part 13. The slope 12 can have a linear profile, an arc-shaped profile, or another suitable profile. In an alternative embodiment, the radially outward force can also be applied by means of another structure, such as a pre-pressed spring and a magnetic force-based attraction or repulsion mechanism, so as to urge the at least one sliding member 31 to move outward radially.

In the embodiment shown in the drawing, the at least one sliding member 31 is spherical, thereby facilitating the at least one sliding member to move by means of rolling. In an alternative embodiment, the at least one sliding member 31 can also have another suitable shape, such as a cylindrical shape and an ellipsoidal shape. It is difficult to view from the longitudinal cross-sectional view as shown, but actually, in the shown embodiment, the at least one sliding member actually includes a first sliding member 31 and a second sliding member 32 that are disposed oppositely and arranged on the periphery of the mandrel symmetrically. In an alternative embodiment, the at least one sliding member can include more sliding members that are distributed uniformly along the mandrel. Preferably, these sliding members are all spherical, cylindrical, or ellipsoidal, thereby facilitating these sliding members to move by means of rolling. The sliding members that are disposed oppositely or distributed along the periphery can balance the force received by the mandrel.

FIG. 3 further shows a contact plate mechanism 3. More specifically, the contact plate mechanism 3 includes a contact plate 301 enabled by an actuator 1 to move from an idle position to an operating position. The actuator 1 acts on an action point 304 at the back of the contact plate 301, and the contact plate 301 is rotatably fixed at one end through a pin 303 and a contact plate reset spring 302. In some embodiments, the contact plate 301 can have a bent part and defines a smooth contact surface.

Figure 6:
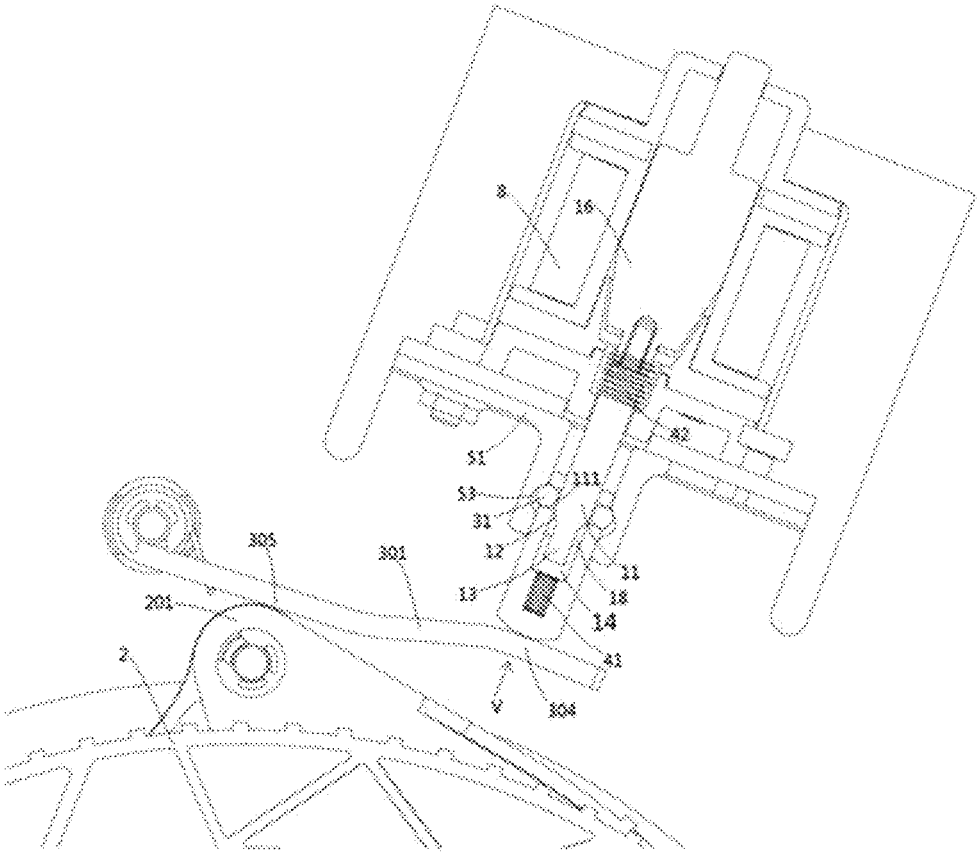
FIG. 6 shows a schematic diagram of an actuation position of a remote triggering apparatus according to an embodiment.

Referring to FIG. 3 or FIG. 6 continuously, a front end of the mandrel 10 can have a groove 18. A side of the groove 18 close to the distal end defines a slope surface 12, and the groove 18 is convenient for defining a position of at least one sliding member. In some embodiments, the mandrel, e.g., the mandrel rod 161, further includes a cap 14 sleeved on the tail end of the mandrel contraction part 13. The slope surface 12 of the mandrel, the mandrel contraction part 13, and the mandrel cap 14 jointly define the groove 18 on the mandrel. In such an embodiment, the groove 18 of the mandrel is an annular groove surrounding the mandrel contraction part. Alternatively, the mandrel may not have a contraction part. Instead, the groove 18 including a proximal end slope surface 12 can be directly disposed on a side wall of the cylindrical mandrel. In this case, the groove 18 is unnecessarily annular, and can have another suitable shape, e.g., one or more semi-spherical grooves corresponding to the at least one sliding member.

The mandrel sleeve 21 is sleeved on the distal end of the mandrel, and at least one opening 22 is provided on the side wall of the mandrel sleeve 21. In some embodiments, the side wall of the mandrel sleeve 21 has (an) opening(s) 22 of which the position(s) and number(s) correspond to those of the at least one sliding member. In some embodiments, the at least one sliding member 31 is located at the first radial position between the contraction position shown in FIG. 3 and the actuation position shown in FIG. 5. For example, the first radial position can be located in or between the groove 18 of the mandrel and the at least one opening 22 of the mandrel sleeve. That is, a part of the at least one sliding member 31 is located in the groove 18 of the mandrel, and the other part of the at least one sliding member 31 is located in the at least one opening 22 of the mandrel sleeve, such that the mandrel sleeve 21 is joined or coupled to the mandrel 10, so as to move toward the actuation position jointly along the channel, and push the contact plate 301 (FIG. 4) of the contact mechanism 3. The contact plate 3 can be provided with a bend.

Figure 4:
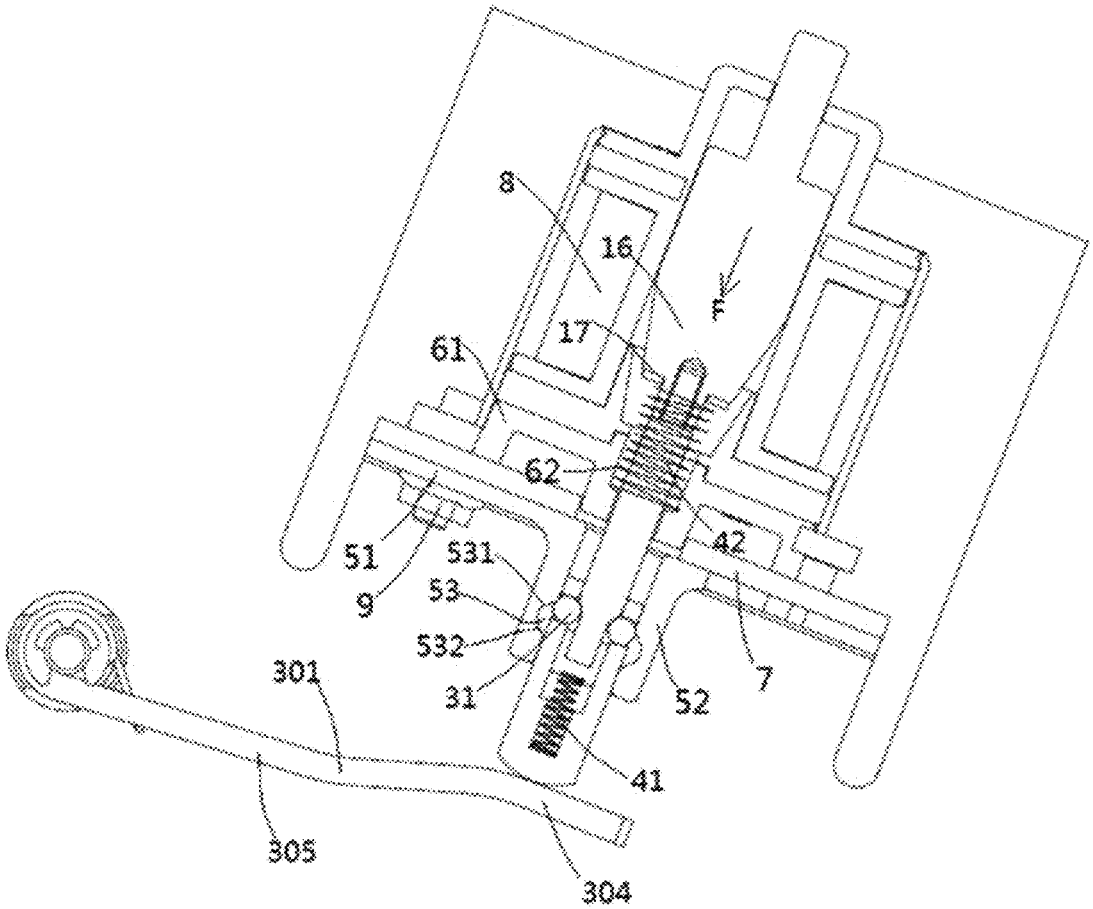
FIG. 4 shows a schematic diagram of a remote triggering apparatus in an actuation process according to an embodiment.

In some embodiments, the shell 50 constitutes an actuator front cover. The actuator front cover can, for example, be connected to an outer side of an end cover 7 of the actuator through a bolt 9. The actuator front cover includes a flat part 51 and a cylindrical part 52 protruded from the flat part. An inner side of the cylindrical part 52 defines at least a part of the channel. In some embodiments, an inner side of the channel of the shell 50 has a recessed part 53. The recessed part 53 is located at a radial outer side of the at least one sliding member 31 at the actuation position. As shown in FIG. 4 and FIG. 5, at the actuation position, the at least one sliding member 31 is pushed out by the mandrel 10, e.g., the slope surface 12 of the mandrel and moves to the second radial position. For example, the second radial position can be in or between the recessed part 53 of the shell and the opening 22 of the mandrel sleeve 21. That is, a part of the at least one sliding member 31 is located in the recessed part 53, and the other part is located in the opening 22. As shown in FIG. 4, when the mandrel is driven to move toward the actuation position, the slope surface 12 of the mandrel 10 acts on the at least one sliding member 31 and applies an action force F to the at least one sliding member. The action force F includes a radially outward component force R. Before the actuation position, the at least one sliding member 31 cannot move outward radially due to the side wall of the channel. At the actuation position, as the side wall of the channel is provided with the recessed part 53, the at least one sliding member 31 can be pushed outward radially and moves to the second radial position.

Further referring to FIG. 5 and FIG. 6, the mandrel sleeve 21 defines a bottom 23. At the position shown in FIG. 5, when the at least one sliding member 31 is about to move or just moves to the second radial position, a gap D still exists between the tail end of the mandrel, e.g., the cap 14 of the mandrel, and the bottom 23 of the mandrel sleeve 21. At the position, as the at least one sliding member 31 has moved to the second radial position, the mandrel 10 is decoupled from the mandrel sleeve 21, and the mandrel 10 is driven to be able to further move forward with respect to the mandrel sleeve 21 in the mandrel sleeve, until the tail end of the mandrel, e.g., the cap 14 of the mandrel, abuts against the bottom 23 of the mandrel sleeve 21. In this case, the side wall 111 of the mandrel limits the at least one sliding member 53 to the second radial position.

At the actuation position shown in FIG. 6, the contact plate of the contact mechanism 3 acts on a connecting rod connection point 201 of the centrifugal mechanism of the sheave 2 at an action point 305, so as to trigger a governor. At the instant when the connecting rod connection point 201 contacts the action point 305, the connecting rod connection point 201 will bring about a large impact. Especially, in a case of a high-speed elevator, the connecting rod connection point 201 will have a larger rotating speed and larger rotational energy, and the impact is transmitted to the actuator 1 through the contact 301. In a past design, the impact force will be directly transmitted to the mandrel of the actual, such that the mandrel is contracted, thus damaging the actuator. Moreover, when an electromagnetic driving force applied to the mandrel is insufficient, the governor is difficult to be triggered. This puts forward more strict requirements for the electromagnetic driving force capability of the actuator, and increases costs of the actuator. In the embodiment of the present invention, the mandrel sleeve is joined to the shell, and the impact force applied to the mandrel sleeve is transmitted to the shell without damaging the mandrel. Moreover, it is unnecessary for the mandrel to resist the impact force, and has greatly lowered the requirements for the electromagnetic driving force of the mandrel.

In some embodiments, a first reset spring 41 is disposed between the mandrel and the mandrel sleeve 21. In some embodiments, the rear end of the mandrel, e.g., the mandrel rod 161, has a boss 17, and the actuator has an inner cover 61. A second reset spring 42 is disposed between the boss 17 and the actuator inner cover 61, e.g., partially accommodated in a notch 62 of the actuator inner cover 61. Under the action of the contact plate reset spring 302, the first reset spring 41, and the second reset spring 42, the actuator can be reset as long as the driving force is removed. Specifically, when the driving force is removed, e.g., when the coil 8 is powered off, the actuator contracts to the position shown in FIG. 5 under the action of the first reset spring 41 and the second reset spring 42. A push-back force of the contact plate 301 is also applied to the mandrel sleeve 21 under the action of the contact reset spring 302. The push-back force is applied to the mandrel sleeve, and therefore, the opening 22 of the mandrel sleeve generates an inward push force Y to the at least one sliding member 31, and the recessed part 53 of the shell generates a counter force f to at least one sliding member 31 that abuts against the recessed part 53, the counter force f having a radially inward component force r. When the mandrel contracts back to the groove 18 of the mandrel and is aligned with the opening 22 of the mandrel sleeve 21, the radially inward component force r pushes the at least one sliding member 31 back to the first radial position. Subsequently, the whole actuator restores to the contraction position shown in FIG. 1 under the action of the contact plate 301, the first reset spring 41, and the second reset spring 42.

Figure 7:
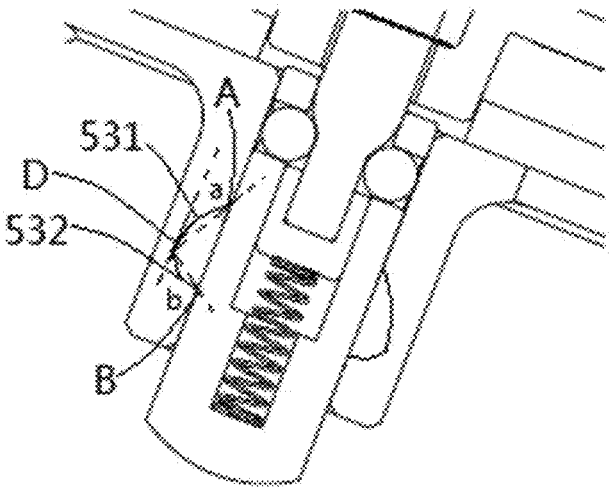
FIG. 7 shows a locally enlarged diagram of an actuator according to another embodiment.

In some embodiments, the recessed part of the inner wall of the channel of the shell can be spherical. As shown in FIG. 7, in some other embodiments, the recessed part 53 has a first portion 531 close to the proximal end and a second portion 532 close to the distal end. In order that the at least one sliding member 31 can easily slide into the recessed part 53, the first portion 531 of the recessed part can have a slope angle a less than 45 degrees, or the first portion 531 of the recessed part has a slope angle a less than a slope angle b of the second portion 532 of the recessed part. Here, the slope angles a and b are respectively included angles between connection lines, of tops A, B of the two portions of the recessed part and a bottom D, and a reference surface. In addition, in some embodiments, the first portion 531 and the second portion 532 of the recessed part 53 can extend linearly or in an arc shape.

In another aspect, a remote triggering apparatus, and a governor and an elevator having the same are provided. The remote triggering apparatus can include the actuator described according to the embodiments. In some embodiments, the remote triggering apparatus further includes: a contact plate enabled to move from an idle position to an operating position, the actuator acting on the back of the contact plate, and the contact plate being rotatably fixed at one end through a pin and a contact plate reset spring. In another aspect, a governor is provided. The pin 303 defines a rotation center of the contact plate 301, and an acting force at an action point 304 between the actuator 1 and the contact plate 301 has an arm of force longer than that of an acting force at an action point 305 between the contact plate 301 and the centrifugal mechanism. Therefore, the impact applied to the actuator can be further reduced.

The specific embodiments described above are merely used to describe the principles of the present invention more clearly, and components are clearly shown or described such that the principles of the present invention are more easily comprehensible. Those skilled in the art can easily make various modifications or changes on the present invention without departing from the scope of the present invention. Therefore, it should be understood that these modifications or changes should all be encompassed in the patent protection scope of the present invention scope of the present invention.

What is claimed is:

1. An actuator, comprising:

a mandrel, the mandrel having a proximal end and a distal end, and the mandrel being driven to move from a contraction position toward an actuation position;

a mandrel sleeve, the mandrel sleeve being sleeved on the distal end of the mandrel; and a shell, the shell defining a channel, wherein the actuator further comprises at least one sliding member, and when the mandrel moves from the contraction position toward the actuation position, the at least one sliding member is located at a first radial position where the mandrel is joined to the mandrel sleeve, such that the mandrel sleeve can move along the channel together with the mandrel; and wherein at the actuation position, the at least one sliding member moves outward radially to a second radial position where the mandrel sleeve is joined to the shell, thus locking the mandrel sleeve;

wherein the mandrel comprises a mandrel stick located at the proximal end and a mandrel rod located at the distal end and connected to the mandrel stick;

wherein a coil is arranged at the periphery of the mandrel stick, and the mandrel stick is made of a magnetic material, wherein the mandrel is driven to the actuation position by a magnetic field generated by the coil when the coil is powered on.

2. The actuator according to claim 1, wherein the mandrel comprises a slope, the slope acts on the at least one sliding member and applies a radially outward component force to the at least one sliding member, and the radially outward component force urges the at least one sliding member to move from the first radial position to the second radial position.

3. The actuator according to claim 1, wherein the at least one sliding member is spherical, cylindrical, or ellipsoidal.

4. The actuator according to claim 1, wherein the mandrel is driven by an electromagnetic driving apparatus.

5. The actuator according to claim 1, wherein the at least one sliding member comprises a pair of opposite sliding members or more sliding members that are distributed uniformly along the periphery of the mandrel.

6. The actuator according to claim 1, wherein the mandrel has a groove, the mandrel sleeve has at least one opening of which the number and position correspond to those of the sliding members, and the at least one sliding member is located at the first radial position between the groove of the mandrel and the at least one opening of the mandrel sleeve.

7. The actuator according to claim 6, wherein one side of the groove of the mandrel close to the proximal end defines a slope, and the slope acts on the at least one sliding member and applies a radially outward component force to the at least one sliding member.

8. The actuator according to claim 6, wherein the mandrel comprises a mandrel body, a mandrel contraction part, and a slope between the mandrel body and the mandrel contraction part.

9. The actuator according to claim 8, wherein the mandrel further comprises a cap covering a tail end of the mandrel contraction part, and the slope, the mandrel contraction part, and the cap jointly define the groove on the mandrel.

10. The actuator according to claim 1, wherein a recessed part is provided on an inner side of the channel of the shell, the recessed part is located at a radial outer side of the at least one sliding member at the actuation position, and at the actuation position, the at least one sliding member is pushed out by the mandrel and moves to the second radial position between the recessed part of the shell and an opening of the mandrel sleeve.

11. The actuator according to claim 10, wherein the recessed part is spherical.

12. The actuator according to claim 10, wherein the recessed part has a first portion close to the proximal end and a second portion close to the distal end, the first portion of the recessed part has a slope angle less than 45 degrees, or the first portion of the recessed part has a slope angle less than that of the second portion of the recessed part.

13. The actuator according to claim 1, wherein after the mandrel reaches the actuation position and the at least one sliding member moves to the second radial position, the mandrel is decoupled from the mandrel sleeve, and the mandrel is driven to further move forward with respect to the mandrel sleeve in the mandrel sleeve, a side wall of the mandrel limiting the at least one sliding member to the second radial position.

14. The actuator according to claim 1, wherein a first reset spring is disposed between the mandrel and the mandrel sleeve.

15. The actuator according to claim 1, wherein a rear end of the mandrel has a boss, and a second reset spring is disposed between the boss at the rear end of the mandrel and an inner side of the actuator.

16. The actuator according to claim 1, wherein the shell constitutes an actuator front cover, the actuator front cover comprises a flat part and a cylindrical part protruded from the flat part, and the cylindrical part defines at least a part of the channel.

17. The actuator according to claim 16, wherein the actuator front cover is connected to an actuator end plate and an actuator inner cover through a bolt, and the actuator inner cover defines a notch that accommodates a second reset spring.

18. A remote triggering apparatus for a governor, comprising the actuator according to claim 1.

19. The remote triggering apparatus according to claim 18, further comprising: a contact plate enabled by the actuator to move from an idle position to an operating position, wherein the actuator acts on the back of the contact plate, and the contact plate is rotatably fixed at one end through a pin and a contact plate reset spring.

20. A governor, comprising the remote triggering apparatus according to claim 18 and a sheave having a centrifugal mechanism.

21. The governor according to claim 20, wherein the remote triggering apparatus further comprises: a contact plate enabled by the actuator to move from an idle position to an operating position, the actuator acts on the back of the contact plate, and the contact plate is rotatably fixed at one end through a pin and a contact plate reset spring, wherein the pin defines a rotation center of the contact plate.

22. An elevator, comprising the actuator according to claim 1.

* * * * *